US007311149B2

(12) United States Patent
Evans

(10) Patent No.: US 7,311,149 B2
(45) Date of Patent: Dec. 25, 2007

(54) JAR WITH ADJUSTABLE PRELOAD

(76) Inventor: Robert W. Evans, Evans Engineering, Inc., 114 Industrial Ct., Conroe, TX (US) 77301

( * ) Notice: Subject to any disclaimer, the term of this patent is extended or adjusted under 35 U.S.C. 154(b) by 527 days.

(21) Appl. No.: 10/700,685

(22) Filed: Nov. 4, 2003

(65) Prior Publication Data

US 2006/0169456 A1 Aug. 3, 2006

(51) Int. Cl.
*E21B 31/107* (2006.01)

(52) U.S. Cl. ..... 166/301; 166/178; 175/304

(58) Field of Classification Search ..... 166/301, 166/178, 98, 99; 175/321, 293, 302, 304
See application file for complete search history.

(56) References Cited

U.S. PATENT DOCUMENTS 3,685,598 A * 8/1972 Nutter ..... 175/302
4,333,542 A * 6/1982 Taylor ..... 175/299
5,170,843 A * 12/1992 Taylor ..... 166/301
7,111,678 B2 * 9/2006 McElroy et al. ..... 166/178

* cited by examiner

*Primary Examiner*—Kenneth Thompson

(74) *Attorney, Agent, or Firm*—Claude E. Cooke, Jr.; Burleson Cooke L.L.P.

(57) ABSTRACT

A jar provided with an adjustable preload has a housing defining an anvil surface and a mandrel, movable relative to the housing under an applied load, defining a hammer surface to impact the anvil surface. A trigger mechanism for releasing the mandrel to cause the hammer surface to impact the anvil surface includes a trigger sleeve axially positioned with the housing and a collet that engages the mandrel during application of a load to the mandrel. The collet releases the mandrel to cause the hammer surface to impact the anvil surface upon being moved into registration with the trigger sleeve against the resistance of a biasing spring disposed within the housing. The preload is adjusted by an adjustment mechanism carried by the housing and coupled to the biasing spring. The adjustment mechanism includes an adjustment mandrel disposed between an end of the upper housing section and an end of the lower housing section. The adjustment mandrel is axially movable relative to the upper and lower housing sections. An adjustment sleeve disposed between the housing sections and around the adjustment mandrel is coupled to the adjustment mandrel such that rotation of the adjustment sleeve relative to the housing sections produces axial movement of the adjustment mandrel relative to the housing sections and adjusts compression of the spring such that a required applied load for the mandrel to be moved against the resistance of the spring preload is adjusted.

13 Claims, 11 Drawing Sheets

66
67
69
65
68
42
38
37
74
77
39
76
40
84
82
78
80

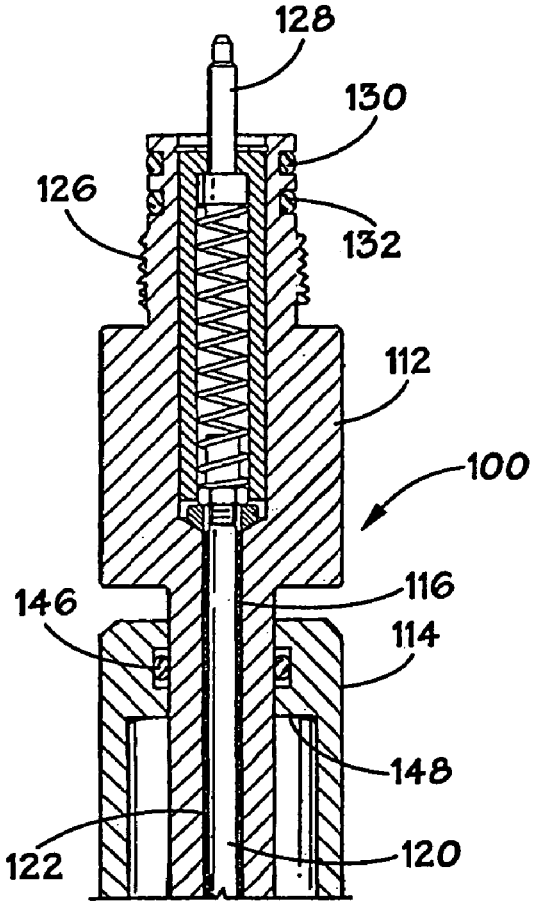
FIG. 3A
FIG. 3B
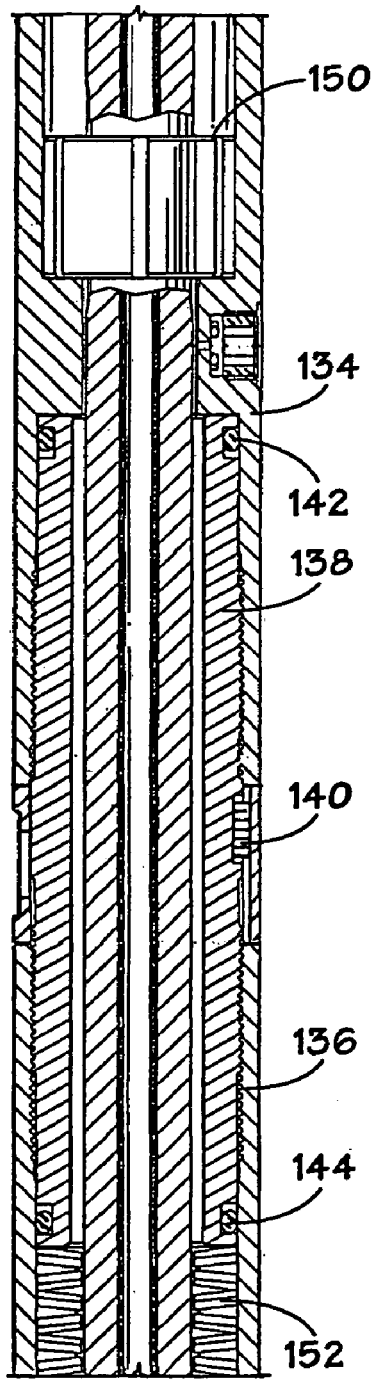

FIG. 4A
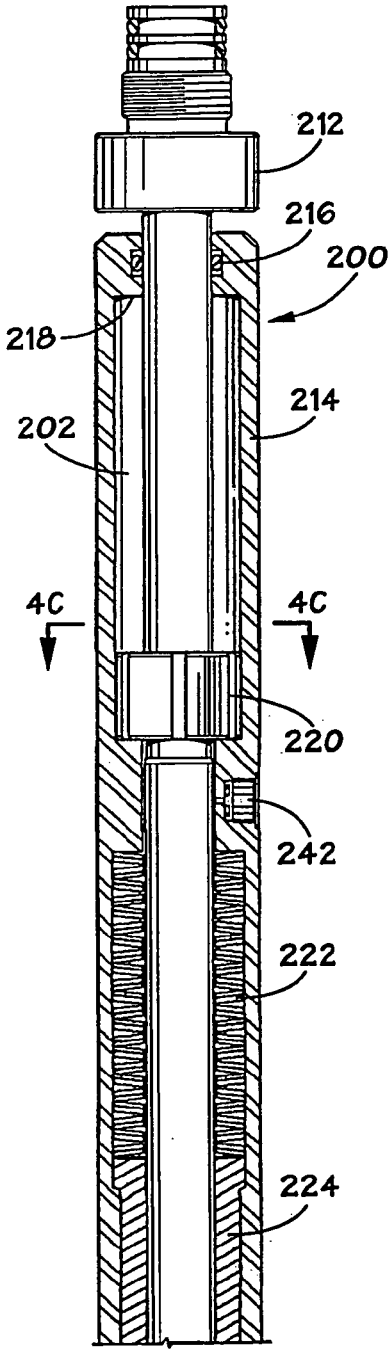
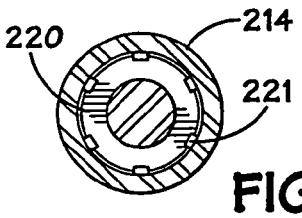
FIG. 4C
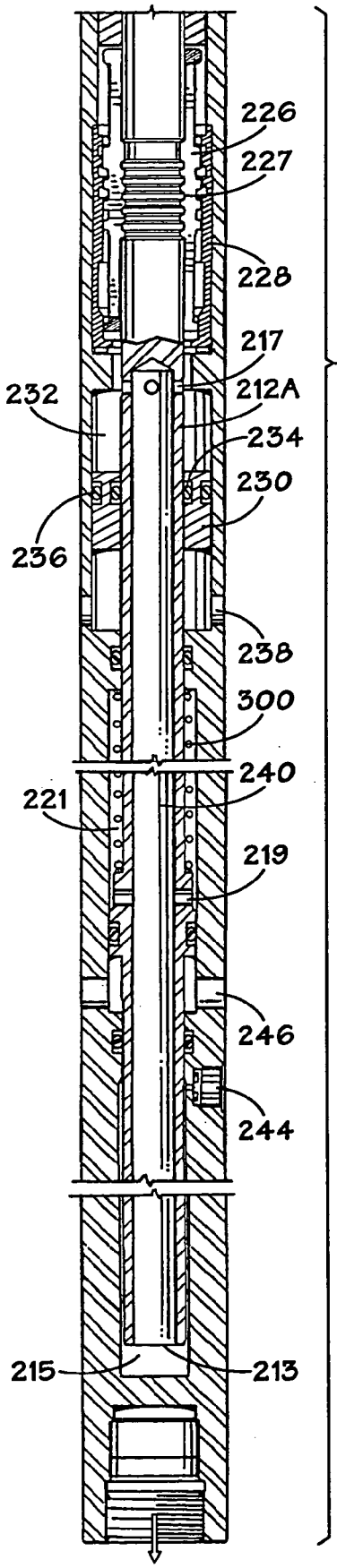
FIG. 4B

FIG. 8
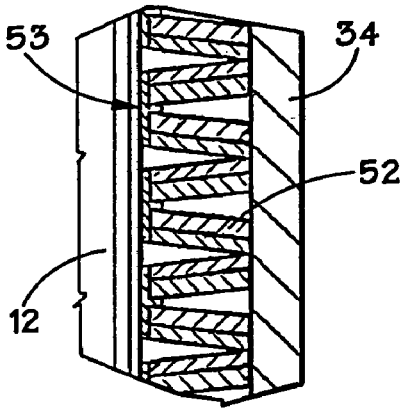
FIG. 10
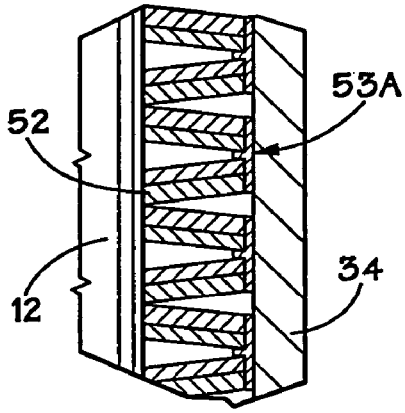
FIG. 11
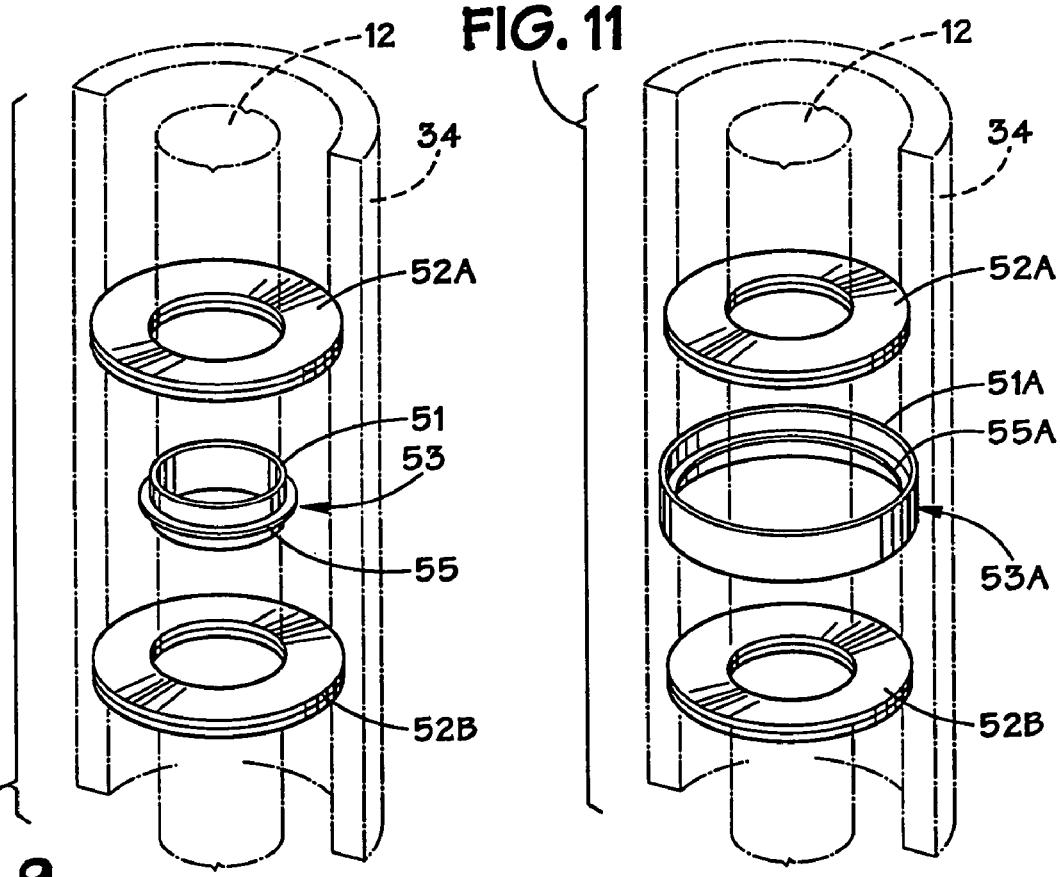
FIG. 9

JAR WITH ADJUSTABLE PRELOAD

FIELD OF THE INVENTION

The present invention relates generally to downhole tools for oil and gas wells, and more particularly to a jar for applying an axial force to dislodge equipment.

BACKGROUND OF THE INVENTION

The sticking of drilling or production equipment in an oil or gas well bore requires that an axial blow be delivered to unstick the equipment. Downhole tools known as "jars" have been used in such situations. One type of jar is a "drilling jar." Another type of jar is a "wireline jar." In the case of a wireline jar, a series of impact blows is delivered to the stuck equipment by manipulation of the wireline. Wireline jars typically have an inner mandrel and an outer housing telescopically coupled together for relative axial, sliding movement. The mandrel carries a hammer and the housing carries an anvil. By directing the hammer to impact the anvil at high velocity, a substantial jarring force may be imparted to the stuck equipment, which is often sufficient to jar the stuck equipment free. A wireline jar is shown and described in U.S. Pat. No. 6,481,495, which is hereby incorporated by reference in its entirety.

There are various types of jars: mechanical, hydraulic, and mechanical-hydraulic. Each type is cocked and subsequently fired to deliver the impact blow. A trigger mechanism initiates firing of the jar by retarding relative motion of the hammer and anvil until an axial strain has been applied to the drill string pipe sufficient to actuate the trigger mechanism. Typically, an axial tensile force applied at the surface pulls on the wireline and thus the mandrel. The trigger mechanism resists the tensile force and causes potential energy to be stored. When the jar trigger mechanism fires, the stored energy is converted to kinetic energy and the hammer hits the anvil.

The trigger mechanism in a mechanical jar includes a spring to resist movement of the mandrel relative to the housing. The spring has a constant response such that a certain amount of applied force applied to the mandrel is required to compress the spring a given amount. A collet is coupled to the mandrel and moves with the mandrel as the spring is compressed under the applied force. The collet and a trigger sleeve keeps the mandrel engaged against the resisting force of the spring. When the applied force on the mandrel exceeds a predetermined amount (i.e., the triggering load), the spring will have been sufficiently compressed for the mandrel to have moved a sufficient distance relative to the trigger sleeve for the collet to release the mandrel, whereupon the jar "fires."

The trigger mechanism in a hydraulic jar includes a piston to pressurize fluid in a chamber to resist movement of the mandrel relative to the housing. The pressurized fluid bleeds off at a predetermined rate. Eventually a pressure is reached at which a chamber seal is opened, and the compressed fluid is allowed to rush out, firing the jar by freeing the mandrel to move rapidly in an axial direction. In a hydraulic jar, the trigger mechanism is not over-pull force dependent; it will trigger at any load that is pulled following a time delay. Advantageously, a hydraulic jar as disclosed in U.S. Pat. No. 6,290,004 includes a mechanical lock preset to trigger at a load greater than the weight hanging below the jar and a hydraulic time delay that allows the jar to be actuated at loads higher than the lock setting without the need to open a chamber seal.

SUMMARY OF THE INVENTION

Adjustment of the preload in a jar is provided by a mechanism to adjust the compression of a biasing spring. The mechanism includes an adjustment mandrel disposed within the jar housing. To adjust the biasing spring compression, the adjustment mandrel is longitudinally translated a desired distance relative to the housing. The movement of the adjustment mandrel causes the initial compression of the spring to be selectively varied.

More particularly, the preload adjustment mechanism includes an adjustment mandrel and an adjustment sleeve keyed to the adjustment mandrel to prevent relative rotational movement between them but to permit relative longitudinal movement. The adjustment mechanism is disposed between two sections of the jar housing. As the adjustment sleeve is rotated relative to the housing sections, the adjustment mandrel translates longitudinally relative to the housing sections and the adjustment sleeve. The adjustment mandrel can be threaded at each end for engagement with threads on the ends of the housing sections to achieve relative translation movement. The housing sections can be rotated relative to the adjustment mandrel to bring them into a secure, abutting relationship with the ends of the adjustment sleeve.

BRIEF DESCRIPTION OF THE DRAWINGS

FIGS. 3A-3D illustrate a hydraulic jar providing for adjustment of the compression of a biasing spring in accordance with the present invention;

FIGS. 4A-4C illustrate a jar in the cocked position and providing gas pressure equalization when there has been no gas intrusion.

FIG. 8 illustrates a carrier for the biasing spring elements of the jars illustrated in FIGS. 1-7;

FIG. 9 illustrates a cross section of a segment of a biasing spring having spring carriers in accordance with FIG. 8 installed thereon;

FIG. 10 illustrates an alternate carrier for the biasing spring elements of the jars illustrated in FIGS. 1-7; and FIG. 11 illustrates a cross section of a segment of a biasing spring having spring carriers in accordance with FIG. 10 installed thereon.

DETAILED DESCRIPTION OF THE PREFERRED EMBODIMENTS

Figure 1A:
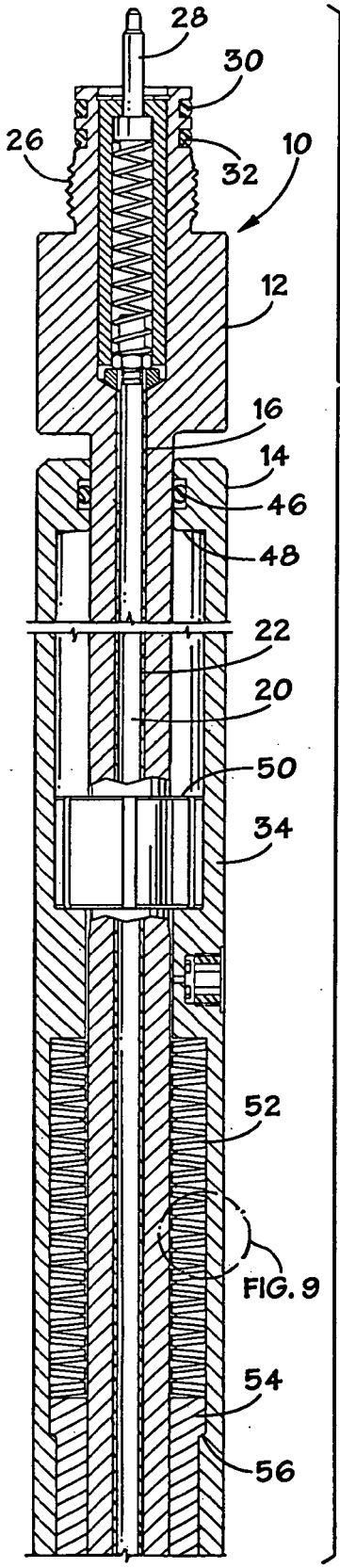
FIGS. 1A-1C illustrate a jar having an adjustable trigger sleeve.
Figure 1B:
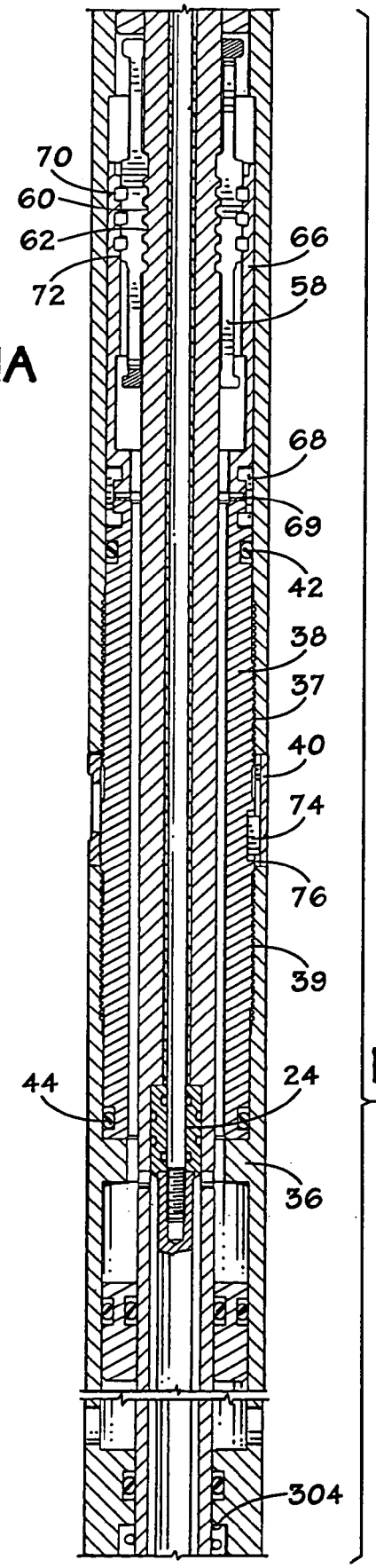
Figure 1C:
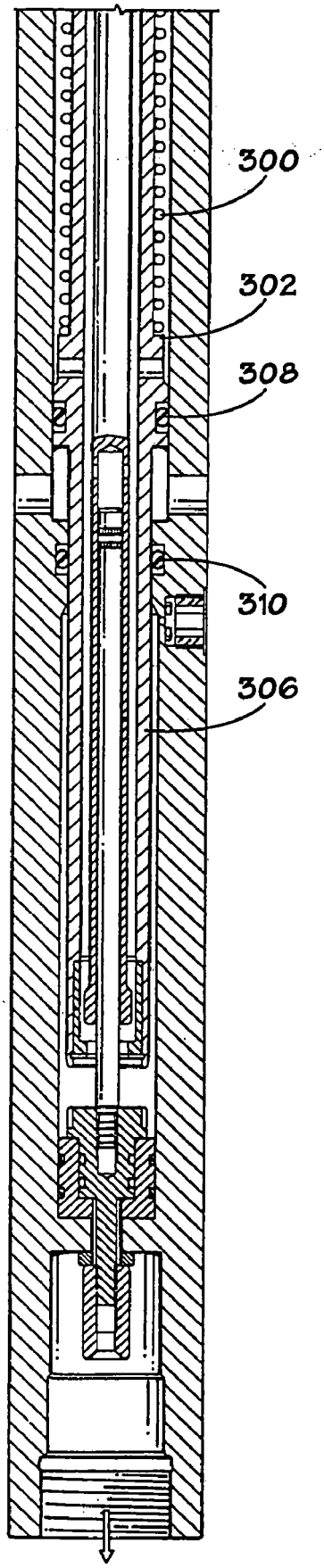

Referring to FIGS. 1A-1C and FIG. 2, there is shown an exemplary embodiment of a jar 10 adapted to be inserted into a well borehole (not shown). The jar 10 has a mandrel 12 disposed within tubular housing 14. The mandrel 12 is axially movable with respect to housing 14. A bore 16 extends the length of mandrel 12. An elongated conductor rod 20 electrically insulated from the mandrel 12 and the housing 14 by an insulating sleeve 22 extends through bore 16 to bulkhead 24. The upper end of mandrel 12 is provided with threads 26 for connection to a wireline connector (not shown). The proximal end 28 of the conductor rod 20 projects beyond the end of mandrel 12 and above the threads 26. The joint between the mandrel 12 and the wireline connector is sealed against fluid passage by a pair of longitudinally spaced O-rings 30 and 32.

The housing 14 has an upper or proximal tubular section 34 and a lower or distal tubular section 36. The upper and lower tubular housing sections are secured together by an adjustment mandrel 38 having threads 37 at the proximal end and threads 39 at the distal end. An adjustment sleeve 40 is disposed between the upper (proximal) and lower (distal) tubular housing sections. The joint between the upper and lower tubular housing is sealed against fluid passage by O-ring seals 42 and 44 carried by adjustment mandrel 38. The upper tubular housing section 34 includes an O-ring seal 46 to seal around mandrel 12 to prevent mud or other debris in the well bore from contaminating the jar. Within upper tubular housing section 34 is formed a downwardly facing annular anvil surface 48. The mandrel 12 includes an upwardly facing, annular hammer surface 50. As described more fully below, when the mandrel 12 is moved axially upward relative to the housing 14 at high velocity, the hammer surface 50 impacts the downwardly facing anvil surface 48 to provide a substantial upward axial jarring force.

Within the upper tubular housing section and disposed around mandrel 12 is a biasing element shown as a spring 52 comprising a stack of Bellville washers. Spring 52 bears against compression ring 54. As shown, compression 54 is disposed within the upper tubular housing section 34 and is restricted in its downward movement relative thereto by a shoulder 56. Compression ring 54, however, may move axially upward relative to the housing 14 to cause compression of spring 52. As will be appreciated, spring 52 resists upward axial movement of compression ring 54 and returns compression ring 54 to the position shown in FIG. 1 after triggering of the jar 10. Spring 52 has a spring constant of, for example, a 1000 lb. per inch.

In resisting upward axial movement of compression ring 54, spring 52 functions to retard the upward movement of the mandrel 12 to allow a build-up of potential energy in the wireline when a tensile load is placed on the mandrel 12 from the surface. In order to retard movement of mandrel 12, a mechanical linkage between the mandrel 12 and the housing 14 is necessary. Such a mechanical linkage includes a generally tubular collet 58 positioned within the upper tubular section 34 and around mandrel 12. A more detailed understanding of the structure of the collet 58 can be obtained by reference to U.S. Pat. No. 6,290,004, which is hereby incorporated by reference in its entirety. As shown in FIG. 1, collet 58 has a plurality of inwardly facing flanges 60. The exterior surface of mandrel 12 is provided with a plurality of external grooves 62 configured to mesh with the inwardly facing flanges 60 of the collet 58. With the inwardly facing flanges 60 retained in physical engagement with the grooves 62, axial force applied to the mandrel 12 will be transmitted through the collet 58 to compression ring 54.

Figure 2:
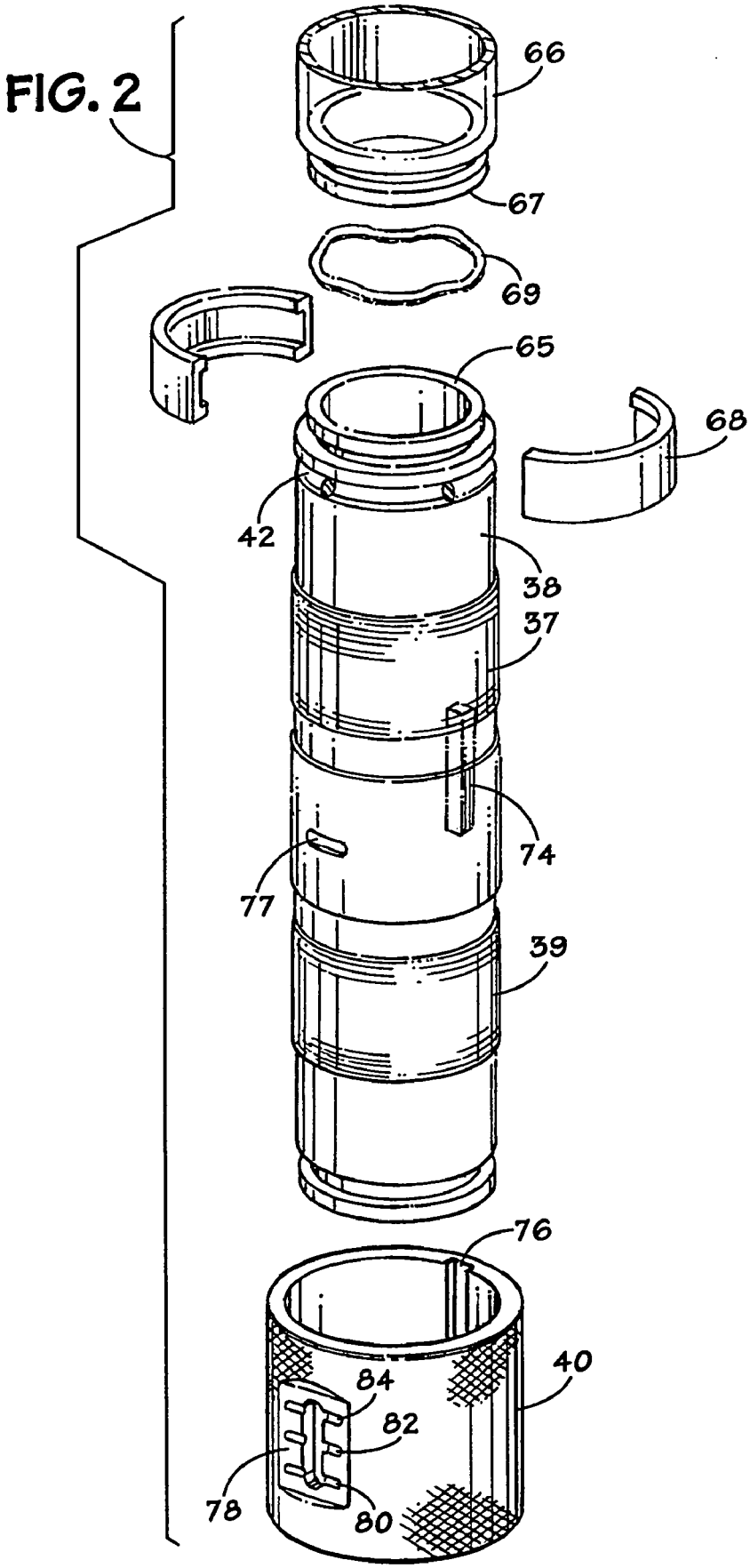
FIG. 2 shows the trigger sleeve adjustment mechanism of the jar of FIGS. 1A-1C.

The mechanical linkage further includes a trigger sleeve 66 positioned within housing 14 proximate the location of collet 58. The trigger sleeve 66 is held in position relative to housing 14 by a split ring retainer 68 that is coupled to adjustment mandrel 38. As best shown in FIG. 2, the lower end of trigger sleeve 66 has a downwardly facing surface 67 which seats against wave spring 69. In turn, wave spring 69 seats against an upwardly facing surface 65 on the proximal end of adjustment mandrel 38. The upper end of trigger sleeve 66 is provided with a plurality of grooves 70. The grooves are sized and configured to receive the outwardly projecting flanges 72 of collet 58.

When an upward axial force is applied to mandrel 12, collet 58 is urged to move upwardly against the resistance of spring 52 and relative to sleeve 66. When the outwardly projecting flanges 72 of collet 58 are in alignment with the grooves 70 of trigger sleeve 66, the collet radially expands to seat the flanges 72 in the grooves 70, which releases the mechanical link between mandrel 12 and housing 14. Mandrel 12 is allowed to rapidly accelerate upwards causing the hammer surface 50 to impact the anvil surface 48. After firing of the jar, the applied force is released. This permits the jar to be re-cocked. In doing so, the collet reengages the mandrel. There are two forces that work together to cause the collet to reengage the mandrel. The first is that the collet has a built in retraction force. The second is the force of the spring pushing on the collet. Because of the angle of the flanges, together an inwardly directed radial force is produced on the collet.

As will be appreciated, the applied load at which the jar is triggered depends upon the spring constant of spring 52 and the range of travel of collet 58 relative to trigger sleeve 66 before the flanges 72 are in registration with grooves 70. For example, ignoring any preloading of the spring, if the spring constant is 1,000 lbs. per inch and the range of movement of collet 58 for registration with trigger sleeve 66 is one inch, the trigger load will be 1,000 pounds. If the range of movement is extended to one and one-half inches, then there will be a corresponding increase in the trigger load to 1,500 pounds. On the other hand, if the range of movement is reduced to one-half inch, then there will be a corresponding reduction in the trigger load to 500 pounds. Adjustment of the trigger load, therefore, can be accomplished by adjusting the position of trigger sleeve 66 within housing 14 to assume a different position relative to collet 58, which effects a different range of movement necessary to place the grooves 70 and flanges 72 in registration.

In order to adjust the position of trigger sleeve 66 within housing 14, the location of adjustment mandrel 38 along the length of housing 14 can be adjusted. To do so, the threaded connections between adjustment mandrel 38 and the upper and lower housing sections 34 and 36 are loosened to permit adjustment mandrel 38 to be rotated relative to the housing sections. As will be appreciated, rotating adjustment mandrel 38 relative the housing sections will cause the adjustment mandrel to be longitudinally translated relative to them. Rotation of adjustment mandrel 38 is accomplished by adjustment sleeve 40. As seen, particularly in FIG. 2, adjustment sleeve 40 surrounds adjustment mandrel 38 and is keyed to it by key 74, which is in elongated keyway slot 76. The keyed connection permits rotation of adjustment sleeve 40 to cause a corresponding rotation of adjustment mandrel 38. The keyway slot 76 for key 74 is elongated to permit the key to move longitudinally with the adjustment mandrel relative to the adjustment sleeve. As seen in FIG. 2, a window 78 is milled into adjustment sleeve 40 so that the extent of longitudinal movement of adjustment mandrel 38 relative to adjustment sleeve 40 and consequently housing 14 can be monitored. An index mark 77 on the mandrel is visible through the window 78. Adjustment sleeve 40 also includes indicia in the form of marks 80, 82 and 84 to identify particular trigger load settings. Alignment of mark 77 with one of marks 80, 82, 84 is an indication of a high, medium, or low trigger load setting. The extent of adjustment of adjustment mandrel 38 is preferably on the order of one-half to one inch from a nominal setting.

Referring to FIGS. 3A-3D, inclusive, there is shown an exemplary embodiment of a jar 100 adapted to be attached to a wireline and inserted into a well borehole (not shown). The jar 100 has a mandrel 112 disposed within tubular housing 114. The mandrel 112 is axially movable with respect to housing 114. A bore 116 extends the length of mandrel 112. An elongated conductor rod 120 electrically insulated from the mandrel 112 and the housing 114 by an insulating sleeve 122 extends through bore 116 to bulkhead 124. The upper end of mandrel 112 is provided with threads 126 for connection to the wireline connector (not shown). The proximal end 128 of the conductor rod 120 projects beyond the end of mandrel 112 and above the threads 126. The joint between the mandrel 112 and the wireline connector is sealed against fluid passage by a pair of longitudinally spaced O-rings 130 and 132.

The housing 114 has an upper tubular section 134 and a lower tubular section 136. The upper and lower tubular housing sections are secured together by an adjustment mandrel 138 (See FIG. 3B). An adjustment sleeve 140 is disposed between the upper and lower tubular housing sections. The joint between the upper and lower tubular housing is sealed against fluid passage by O-ring seals 142 and 144 carried by adjustment mandrel 138. The upper tubular housing section 134 includes an O-ring seal 146 to seal around mandrel 112 to prevent mud or other debris in the well bore from contaminating the jar. Within upper tubular housing section 134 is formed a downwardly facing annular anvil surface 148. The mandrel 112 includes an upwardly facing annular hammer surface 150. As described more fully below, when the mandrel 112 is moved axially upward relative to the housing 114 at high velocity, the hammer surface 150 impacts the downwardly facing anvil surface 148 to provide a substantial upward axial jarring force.

A spring 152 is disposed within the lower tubular housing section around mandrel 112, which is shown to comprise a stack of Bellville springs. Spring 152 bears against the lower end of adjustment mandrel 138. As will be described, spring 152 resists upward axial movement of mandrel 112. In resisting upward axial movement of mandrel 112, a build-up of potential energy in the drill string occurs when a tensile load is placed on the mandrel 112 from the surface. Spring 152 provides the jar 100 with a preload that enables the operator to apply an upward axial force on the mandrel 112.

A fluid chamber is established within the open internal spaces of housing 114 and extends generally longitudinally downward through the length of the housing 114. The fluid chamber is sealed at its lower end by a pressure-compensating piston 154. The interior of the housing 114 below the pressure-compensating piston 154 is vented to the well by ports 156. Fluid pressure is established in the fluid chamber by an actuating piston 158. As described more fully below, actuating piston 158 restricts fluid flow within the fluid chamber, which enables a significant over-pull to be applied to the mandrel 112 followed by a gradual bleed off of fluid pressure through the piston 158 and eventual triggering of the jar 10.

The actuating piston 158 seals the fluid chamber to permit a build up of pressure therein. In this way, fluid in the chamber resists the upward movement of the mandrel 112 relative to the housing 114. Upward movement of the mandrel 112 relative to the housing 114 reduces the volume of the fluid chamber above the actuating piston 158 and causes a significant increase in the fluid pressure within that space. The fluid pressure provides an axial force to resist the relative movement of the mandrel and the housing. This resistance to relative movement creates a large potential energy.

The actuating piston 158 has a smooth cylindrical bore 160 and allows the mandrel 112 to slide therein. The bore 160 is sealed against the leakage of fluid around its exterior surface and past the mandrel 112 by a pair of O-rings 162 and 164 positioned proximate the outer surface and inner surface of the actuating piston 158, respectively. The actuating piston 158 may be in accordance with that shown in U.S. Pat. No. 6,290,004. The actuating piston 158 has a flow passage 166. The flow passage 166 permits only restricted flow of fluid from the fluid chamber above the piston 158. The restricted flow causes the build up of pressure but also allows the actuating piston 158 to move in an upwardly direction. The tubular housing section 136 includes an upwardly facing annular shoulder 170 against which compression ring 168 bears. Shoulder 170 defines the lower limit of downward movement of the actuating piston 158.

Figure 3C:
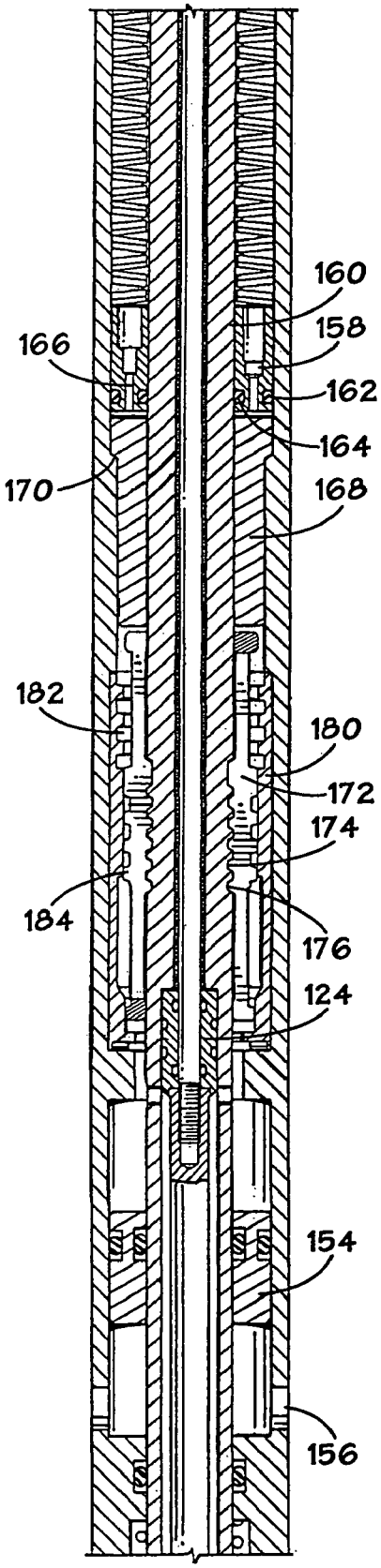
Figure 3D:
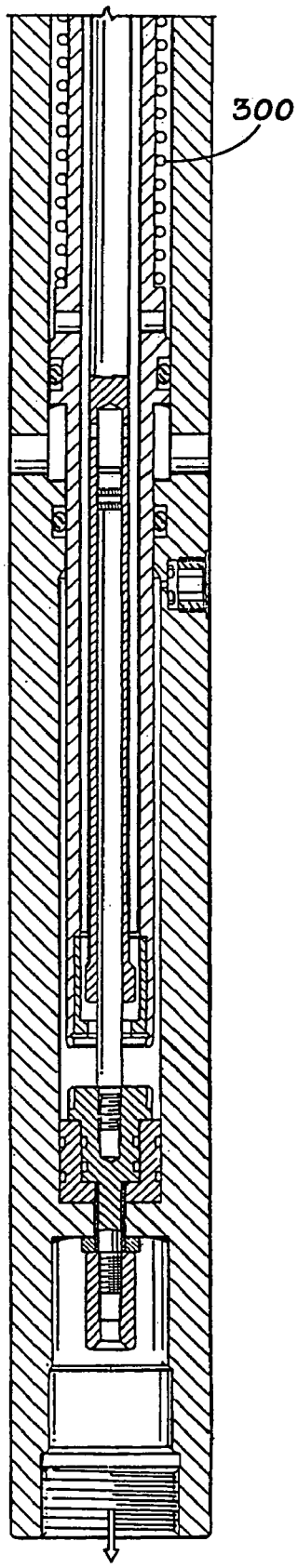

In order to retard movement of mandrel 112, a mechanical linkage between the mandrel 112 and the housing 114 is necessary. Such a mechanical linkage includes a generally tubular collet 172 positioned within the lower tubular section 136 and around mandrel 112. As shown in FIG. 3C, collet 172 has a plurality of inwardly facing flanges 174. The exterior surface of mandrel 112 is provided with a plurality of external grooves 176 configured to mesh with the inwardly facing flanges 174 of the collet 172. With the inwardly facing flanges 174 retained in physical engagement with the grooves 176, axial force applied to the mandrel 112 will be transmitted through the collet 172 to compression ring 168.

The mechanical linkage further includes a trigger sleeve 180 positioned within housing 114 proximate the location of collet 172. The trigger sleeve 180 is allowed to move slightly relative to housing 114. The upper end of trigger sleeve 180 is provided with a plurality of grooves 182. The grooves are sized and configured to receive the outwardly projecting flanges 184 of collet 172. When an upward axial force is applied to mandrel 112, collet 172 is urged to move upwardly relative to trigger sleeve. 182 against the resistance of spring 152 and the fluid pressure in the fluid chamber above actuating piston 158. When the outwardly projecting flanges 184 of collet 172 are in alignment with the grooves 182 of trigger sleeve 180, the collet radially expands to seat the flanges 184 in the grooves 182, which releases the mechanical link between mandrel 112 and housing 114. Mandrel 112 is allowed to rapidly accelerate upwards causing the hammer surface 150 to impact the anvil surface 148.

In order to trigger jar 100, an upwardly directed tensile load is applied to the mandrel 112. As force is applied to the mandrel 112, upward axial force is transmitted to the collet 172. The upper annular surface of the collet is brought into engagement with compression ring 168. If the applied load exceeds the preload of spring 152, the actuating piston 158 moves upwardly and compresses the fluid enclosed within the fluid chamber above the piston. The upward movement of the actuating piston 158 and collet 172 is resisted by the pressure of the fluid compressed within the fluid chamber and by spring 152, which allows potential energy in the wireline to build. Upward movement of the actuating piston 158 produces a restricted flow of fluid from the high-pressure side of the fluid chamber through the flow passage 166. The actuating piston 158, the collet 172, and the mandrel 112 continue a steady but slow upward movement as fluid continues to bleed high pressure from the fluid chamber. When enough fluid has been bleed off such that the collet has moved sufficiently for the outwardly facing flanges 184 to be in alignment with the grooves 182 of trigger sleeve 180, the collet will release the mandrel and allow it to translate upwards freely and rapidly relative to the housing 114. The mandrel 112 accelerates upward rapidly bringing the hammer surface 150 of the mandrel 112 rapidly into contact with the anvil surface 148 of the housing 114. If tension on the mandrel 112 is released, spring 152 urges the piston 158 downwardly and fluid is introduced into the chamber above the piston through a check valve in the piston.

As will be appreciated, the resistance of spring 152 establishes a "preload," which is an amount of load that must be applied before collet 172 can begin to move relative to trigger sleeve 180. That is, compression of spring 152 results in a reaction force that pushes down against the piston. In order to move collet 172 upwardly, an applied load to the mandrel 112 must initially overcome the reaction force due to the compression of the spring 152 or the "preload." Thereafter, additional load must be applied to overcome the further force imposed by the spring constant plus the resisting force of the pressure of the compressed fluid in the fluid chamber. The preloading serves as a "lock" against premature triggering of the jar due to the weight of the tools suspended below the jar.

In order to further understand the effect of establishing an initial compression of spring 152 and its adjustment, consider that the spring 152 has a "spring rate" that constitutes the increase in force for a given deflection. Although spring 152 could have a non-linear spring rate, preferably it has a linear spring rate. The length of spring 152 in an unloaded condition is the "free length." The length of the spring after compression is the "stack height." If spring 152 were to be compressed until it is flat and no further travel is possible, the spring force would be the maximum available and spring length would be its "solid height." The preload length of the spring is the stack height prior to applying tension to the jar. The extent of compression is the free length minus the stack height when the jar triggers. The load at any spring height is calculated by multiplying the compression and the spring rate. In an example wherein the free length is 5.25 inches, the solid height is 1.75 inches, and the spring rate is 1500 lb./inch, compression of the spring 0.25 inch, the preload would be 0.25×1500=375 lbs. In order to begin to move the mandrel, it would be necessary to pull 375 lbs. of applied load. If one inch of travel is needed to release the mandrel from the collet, so the release load is 1.25×1500=1875 lbs. The preload can be increased by additional compression of the spring. If the compression is increased by one inch to 1.25 inch, the preload becomes 1875 lbs. An additional one inch of travel to release the mandrel would require a total of 2.25 inches of spring compression and the release load would increase to 2.25×1500=3375 lbs.

In order to adjust the compression or preload of spring 152, the location of adjustment mandrel 138 along the length of housing 114 is adjusted. To do so, the threaded connections between adjustment mandrel 138 and the upper and lower housing sections 134 and 136 are loosened to permit adjustment mandrel 138 to be rotated relative to the housing sections. As will be appreciated, rotating adjustment mandrel 138 relative the housing sections will cause the adjustment mandrel to be translated relative to them. Rotation of adjustment mandrel 138 is accomplished by adjustment sleeve 140. As seen, adjustment sleeve 140 surrounds adjustment mandrel 138 and is keyed to it using an elongated keyway slot. The keyed connection permits rotation of adjustment sleeve 140 to cause a corresponding rotation of adjustment mandrel 138. The keyway slot is elongated to permit the key to move longitudinally with the adjustment mandrel relative to the adjustment sleeve.

Figure 4D:
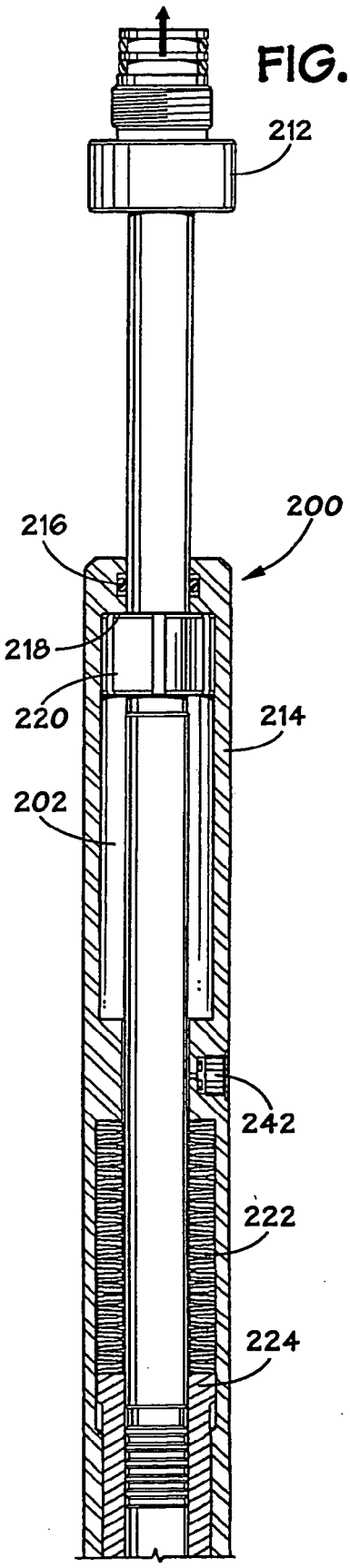
FIGS. 4D-4E illustrate the jar of FIGS. 4A-4C in the triggered position.
Figure 4E:
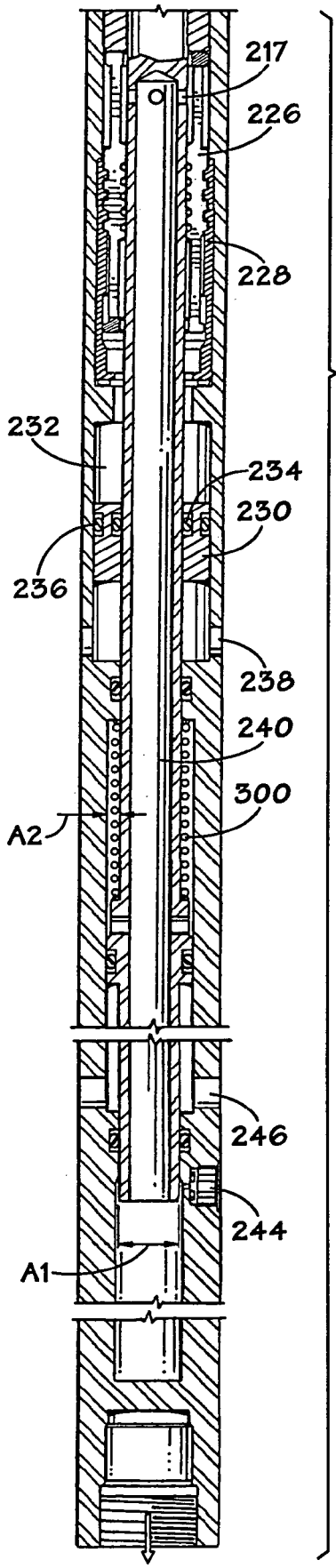

A fluid-filled jar, such as that shown in U.S. Pat. No. 6,481,495, is subject to a condition known as "gas locking," which occurs when gas in solution in the well bore enters the fluid chamber of the jar. Typically, gas locking occurs when gas permeates the elastomer seals in the jar due to a difference in the partial pressures between the gas in the well bore and the fluid inside the jar. Gas then becomes trapped in the fluid chamber of the jar. As the jar is moved uphole, the hydrostatic pressure becomes lower and the gas inside the jar will expand. The effect is that the jar will be biased ("gas biasing"), which can result in the jar triggering prematurely or not at all. The jar 200 shown in FIG. 4 avoids gas locking by balancing the gas biasing effect. As shown in FIGS. 4A and 4B, jar 200 is in the cocked position. In FIGS. 4D and 4E, jar 200 is in the triggered position.

Jar 200 in FIG. 4 has a mandrel 212 and a housing 214. A seal 216 is provided between mandrel 212 and housing 214. A fluid chamber 202 extends through the tool. An anvil surface 208 on housing 214 is impacted by hammer 220 when the jar is triggered. As can be seen in FIG. 4C, hammer 220 has slots 221 extending along its length to permit fluid to move within the fluid chamber 202 of the jar. Jar 200 includes biasing spring 222, compression ring 224, and a triggering mechanism including collet 226 and trigger sleeve 228. The collet 226 engages flanges 227 on mandrel 212. A floating piston 230 is disposed within cylinder bore 232 and carries inner seal 234 and outer seal 236. Ports 238 in cylinder bore 232 below piston 230 are open to hydrostatic pressure. Above piston 230, the cylinder bore is filled with fluid. Chamber 240 is also filled with fluid. Also provided in jar 200 are upper and lower fluid fill ports 242 and 244, respectively. Additional ports 246 open to hydrostatic pressure are provided above fluid fill port 244.

As shown in FIG. 4B, the mandrel 212 has a section 212A below flanges 227. Mandrel section 212A is hollow and terminates in an open end 213. The interior of hollow mandrel section 212A is in fluid communication with chamber 215. In the upper portion of mandrel section 212A, fluid ports 217 are provided. The hollow interior of mandrel section 212A is placed in fluid communication with fluid chamber 202 by ports 217. This permits the interior and exterior of the mandrel to be pressure balanced. The exterior of mandrel 212 is surrounded by oil in fluid chamber 202. The interior of mandrel section 212A and the exterior portion of mandrel section 212A exposed to chamber 215 are surrounded by oil. Additional fluid ports 219 are provided in mandrel section 212A to oil-filled chamber 221.

In FIG. 4, there has been no gas invasion into the fluid chamber and the pressure-balancing piston 230 is not bottomed out within bore 232. With floating piston 230, which has fluid chamber pressure above and hydrostatic pressure below, the fluid chamber pressure in the jar can be balanced against the hydrostatic pressure of the well bore. As the jar moves downhole, hydrostatic pressure increases. The increase in hydrostatic pressure acts on piston 230 and causes it to be urged upwardly. This has the effect of increasing the pressure of the fluid in the chamber to balance the increase in hydrostatic pressure. As shown in FIGS. 4D and 4E, after triggering of the jar, piston 230 remains stationary with respect to the housing and the fluid in the jar chamber remains at hydrostatic pressure.

Figure 5A:
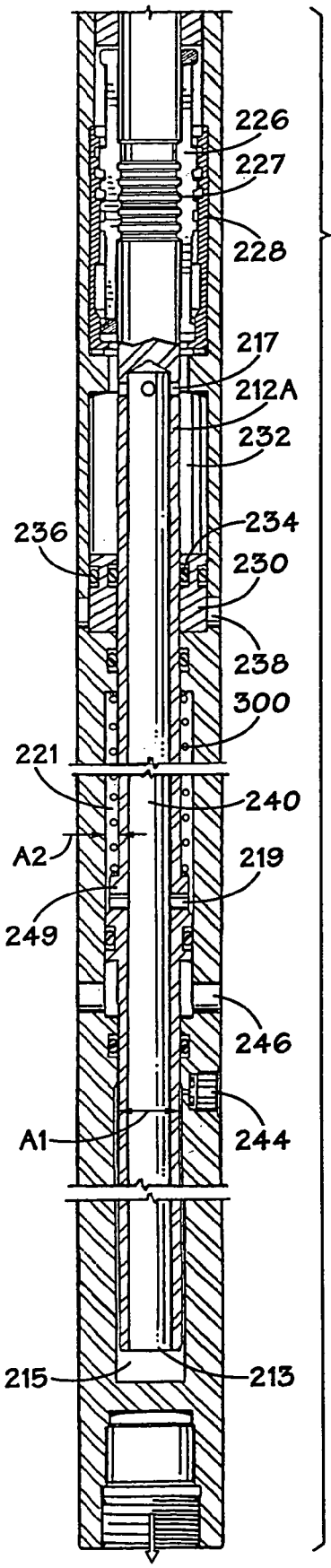
FIGS. 5A and 5B illustrate the lower portion of the jar of FIG. 4 in the cocked position and triggered positions, respectively, when there has been gas intrusion.
Figure 5B:
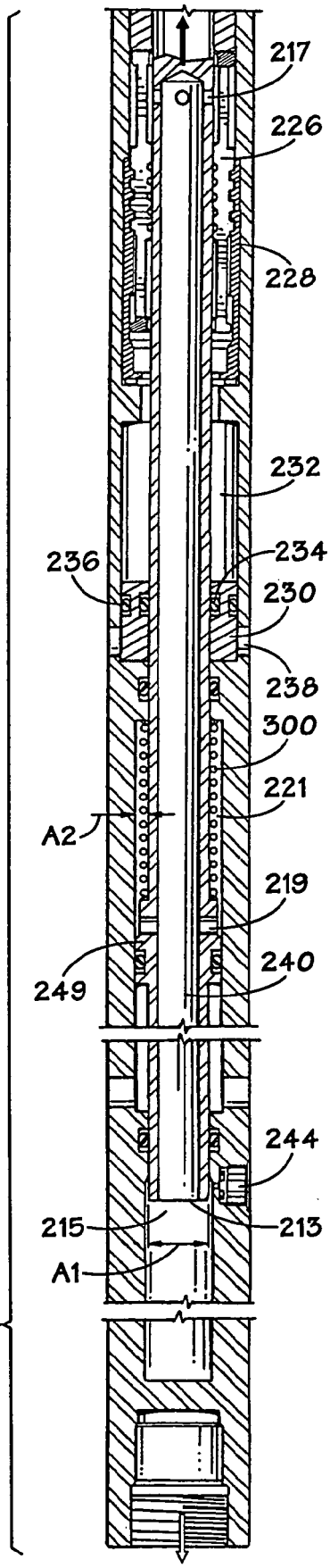

In FIGS. 5A and 5B, the lower section of the jar shown in FIG. 4 is shown in the cocked and triggered positions, respectively. Also, the assumption is that there has been gas intrusion to the fluid chamber of the jar and gas pressure higher than hydrostatic is present in the jar chamber. An increase in gas pressure causes floating piston 230 to move downwardly to shoulder in bore 232. Any further increase in gas pressure increases the pressure in the jar fluid chamber. Gas pressure internal to the jar and communicated through ports 217 acts on the area A1 of the lower mandrel section 212A to force the mandrel 212 upwardly to "open" the jar. Internal gas pressure also acts on an area A2, which is substantially equal to the area A1. Gas pressure acting on area A2 creates an opposing force that urges the mandrel downwardly to "close" the jar. Accordingly, the intrusion of gas into the fluid chamber of the jar can be used to create balancing forces that allow the jar to continue to function.

More specifically, the end 213 of mandrel section 212A has a cross-section area A1 exposed to fluid pressure within the housing fluid chamber 215 that produces a force urging the mandrel in a first, upward direction. The chamber 221 forms an annulus of cross-section area A2. An intermediate segment 249 is within the annulus of chamber 221 and presents an annular surface of cross-section area A2 substantially equal to the cross-section area A1. The annular surface of segment 249 is exposed to fluid pressure within the housing fluid chamber, which produces an opposing force that urges the mandrel in a second, opposite direction (i.e., downward) to the first direction.

Figure 6A:
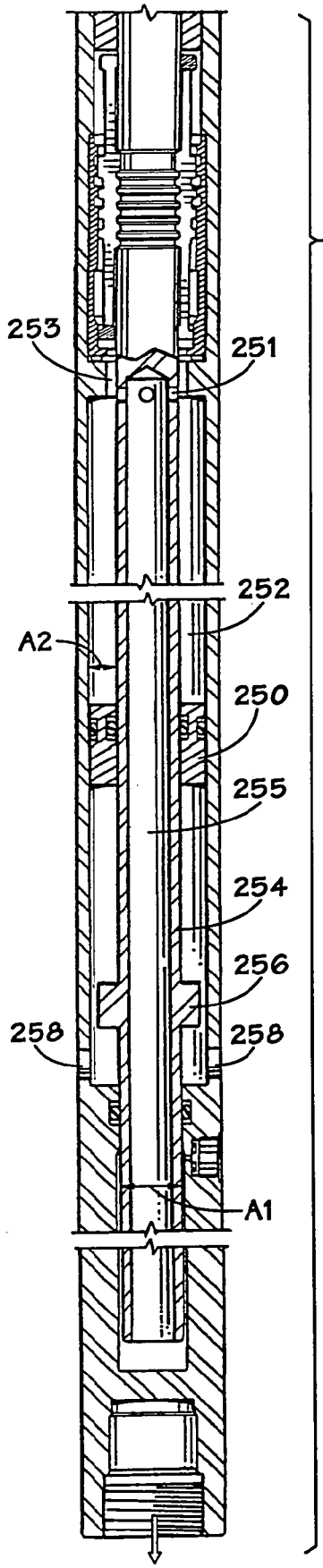
FIGS. 6A and 6B illustrate an alternate configuration for the lower portion of the jar of FIG. 4 in the cocked and triggered positions, respectively, when there has been no gas intrusion.
Figure 6B:
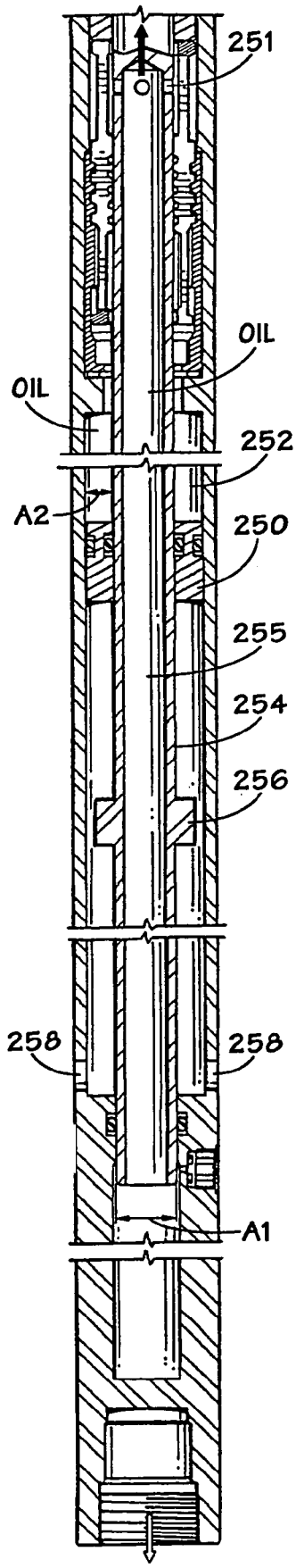

In FIG. 6, an alternate configuration for the lower section of the jar shown in FIGS. 4 and 5 is shown. In FIG. 6A, the jar is in the cocked position; and in FIG. 6B the jar is in the triggered position. As seen in FIG. 6, a piston 250 moves within an elongated cylindrical bore 252. A portion of the mandrel 254 has a circumferential shoulder 256 that serves as a piston stop. The mandrel portion 254 has an area A1 and the cylindrical bore 252 has an area A2, which is substantially equal to A1. At the lower end of cylindrical bore 252 are ports 258 to hydrostatic pressure. When there is no gas invasion into the jar, piston 250 floats within cylindrical bore 252 as shown in response to hydrostatic pressure changes. An increase in hydrostatic pressure causes the piston 252 to be urged upwardly, which has the effect of increasing pressure in the jar fluid chamber to balance the hydrostatic pressure. Ports 251 in mandrel 212 provide for fluid communication between the fluid chamber 253 exterior to the mandrel and the fluid chamber 255 interior to the mandrel.

Figure 7A:
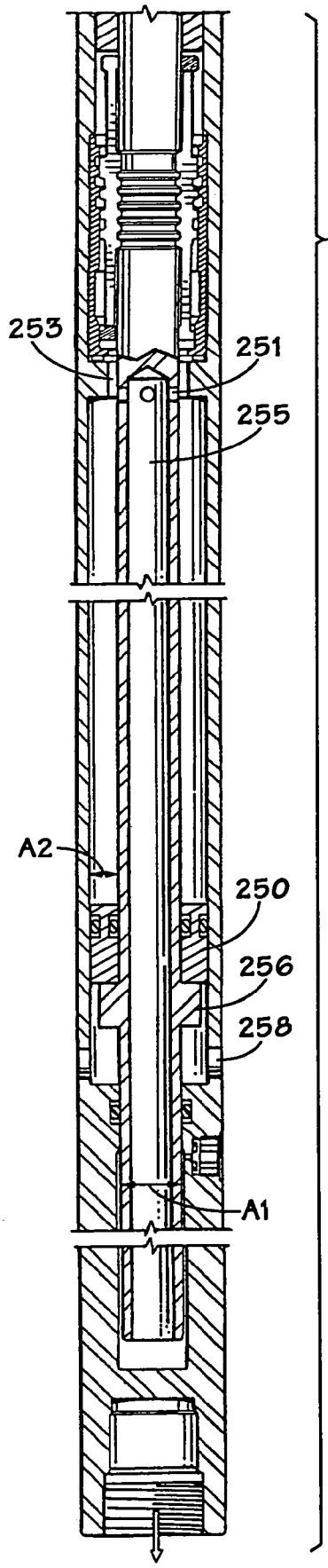
FIGS. 7A and 7B illustrate the alternate configuration of FIG. 6 in the cocked position and triggered positions, respectively, when there has been gas intrusion.
Figure 7B:
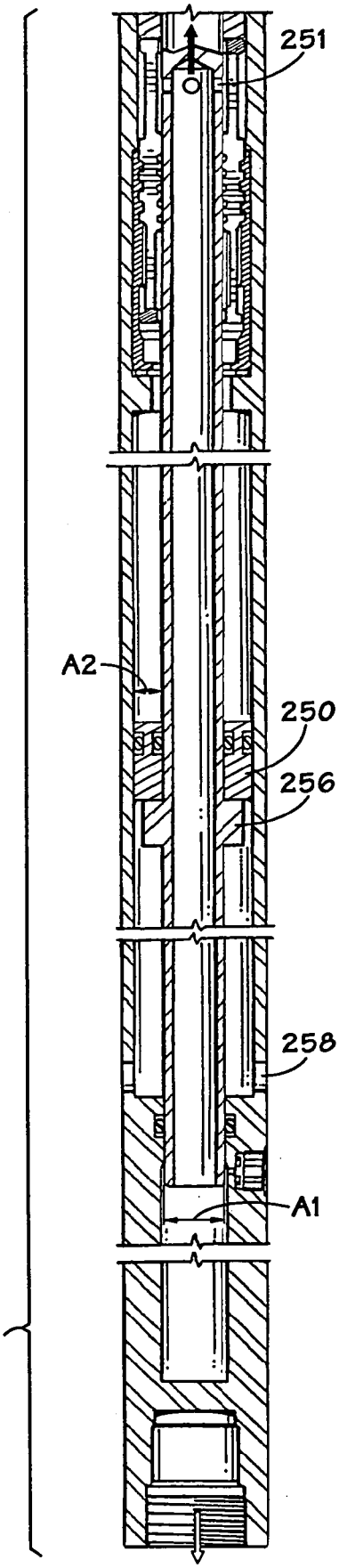

In FIG. 7, the alternate configuration for the lower section of the jar shown in FIG. 6 is illustrated when there has been gas intrusion to the fluid chamber of the jar and gas pressure higher than hydrostatic is present in the jar chamber. In FIG. 7A, the jar is in the cocked position; and in FIG. 7B the jar is in the triggered position. As shown, piston 250 is forced against piston stop shoulder 256. Any further increase in gas pressure increases the pressure in the fluid chamber of the jar. The internal pressure acts on area A1 to create a force. But, the internal pressure also acts on area A2 to create an equalizing force in opposition.

As seen in the jars of FIGS. 1, 3, 4 and 5, a lower spring 300 is provided. Spring 300 is disposed between a shoulder 302 on the mandrel and a shoulder 304 on the housing. Thus, when the jar is triggered and the mandrel moves upwardly to impact the hammer against the anvil, spring 300 is compressed. When the jar is to be cocked, the spring 300 pushes downwardly on the mandrel to return it to its initial position. As can be seen in, for example, FIG. 1C, a lower section 306 of the mandrel has an upper seal 308 and a lower seal 310. These seals can produce drag that inhibits the return of the mandrel to the cocked position of the jar. Spring 300 facilitates movement of the mandrel to the cocked position.

In FIG. 9, a detailed view of the spring carrier for the biasing spring, such as spring 52 in FIG. 1A, is shown. The spring 52 is a Bellville spring comprising a plurality of "washer-like" spring elements. A Belleville washer is a compact type of spring in the shape of a washer that has been pressed into a dished shape and then hardened and tempered. In using a stack of Belleville washers as a spring, there can be a tendency to buckle and cause rubbing on either the inside diameter or the outside diameter. Rubbing causes a hysteresis effect when the spring is compressed and then released. Thus, the spring force is not constant and the triggering load of a jar cannot be repeated. The use of the spring carrier assists in reducing the hysteresis effect.

The washer elements of spring 52 are loaded onto the mandrel as seen in FIG. 1A. As seen there, the convex sides of adjacent dished shape washers are in contact. To facilitate placing the washer elements onto the mandrel, a spring carrier 53 shown in the cross section of FIG. 8 is adapted to be placed to the inside of the spring 52 against the mandrel wall surface. As shown in the perspective view of FIG. 9, carrier 53 comprises a ring 51 having an external circumferential flange 55. Adjacent washer elements 52A and 52B are shown in the exploded view of FIG. 9.

In FIGS. 10 and 11, a detailed view of an alternate spring carrier 53A is shown. Spring carrier 53A comprises a ring 51A having an internal circumferential flange 55A. In the exploded view of FIG. 11, washer elements 52A and 52B are shown relative to carrier 53A.

Many modifications and changes may be made to the illustrated embodiments by those having ordinary skill in the art without departing from the scope and spirit of the present invention as set forth in the appended claims. For example, a coil spring may be suitable substituted for the Bellville-type spring. Also, as can be seen among the various embodiments described, a mechanical jar having the trigger load adjustment feature such as shown in FIG. 1 can be provided with the gas equalization features described with respect to the jar of FIGS. 4 and 5 and the jar of FIGS. 6 and 7.

What is claimed is:

1. A jar having an adjustable preload, comprising:

a housing having an anvil surface and defining a fluid chamber;

a mandrel moveable relative to the housing under an applied load and having a hammer surface to impact the anvil surface;

a trigger sleeve axially positioned within the housing;

a collet engaging the mandrel and releasing the mandrel to cause the hammer surface to impact the anvil surface upon being moved into registration with the trigger sleeve;

a spring disposed within the housing to permit a preload to be applied to the mandrel without producing longitudinal axial movement of the collet relative to the trigger sleeve;

a piston moveable within the fluid chamber to cause a build up of pressure in the fluid chamber in resistance to longitudinal, axial movement of the collet relative to the trigger sleeve upon application of a load to the mandrel in excess of the preload until the collet releases the mandrel; and an adjustment mechanism carried by the housing and coupled to the spring to adjust compression of the spring and thereby adjust an amount of preload permitted to be applied to the mandrel.

2. The jar of claim 1, wherein the spring comprises a stack of Bellville springs.

3. The jar of claim 1, wherein the collet surrounds the mandrel and has a plurality of inwardly facing circumferential flanges and a plurality of outwardly facing circumferential flanges; the mandrel has an exterior surface provided with a plurality of circumferential external grooves configured to mesh with the inwardly facing flanges of the collet; and the trigger sleeve has an upper end provided with a plurality of circumferential grooves configured to receive the outwardly projecting flanges of the collet upon expansion of the collet when the collet is in registration with the trigger sleeve.

4. The jar of claim 1, wherein the housing comprises upper and lower housing sections and the adjustment mechanism comprises an adjustment mandrel disposed between an end of the upper housing section and an end of the lower housing section, the adjustment mandrel being axially movable relative to the upper an lower housing sections.

5. The jar of claim 4, wherein the adjustment mechanism further comprises an adjustment sleeve disposed between the housing sections and around the adjustment mandrel, the adjustment sleeve being coupled to the adjustment mandrel such that rotation of the adjustment sleeve relative to the housing sections produces axial movement of the adjustment mandrel relative to the housing sections.

6. The jar of claim 5, wherein axial movement of the adjustment mandrel produces compression of the spring such that a required applied load for the collet to be moved against the spring resistance in adjusted.

7. The jar of claim 4, wherein the adjustment mandrel is an elongated tubular member having threads on each end and the housing sections have threads at the ends for connection to threads at the ends of the upper and lower housing sections such that rotation of the adjustment mandrel relative to the housing sections produces axial movement of the adjustment mandrel relative to the housing sections.

8. The jar of claim 7, wherein the adjustment mechanism further comprises an adjustment sleeve disposed between the housing sections and around the adjustment mandrel, the adjustment sleeve being keyed to the adjustment mandrel such that rotation of the adjustment sleeve relative to the housing sections produces rotation of the adjustment mandrel and axial movement of the adjustment mandrel relative to the housing sections.

9. The jar of claim 8, wherein the adjustment sleeve as keyed to the adjustment mandrel with an elongated key slot to permit relative axial movement between the adjustment sleeve and the adjustment mandrel as they are being rotated.

10. A jar having an adjustable preload, comprising:

a housing having an anvil surface and defining a fluid chamber;

a mandrel movable relative to the housing under an applied load and having a hammer surface to impact the anvil surface;

a mechanical linkage between the mandrel and the housing, the mechanical linkage releasing the mandrel to cause the hammer surface to impact the anvil surface when a triggering load is applied to the mandrel;

means for permitting a preload to be applied to the mandrel without producing longitudinal, axial movement of the mandrel relative to the housing;

a piston moveable within the fluid chamber to cause a build up of pressure in the fluid chamber in resistance to longitudinal, axial movement of the mandrel relative to the housing upon application of a load to the mandrel in excess of the preload;

a fluid flow restriction device metering a release of fluid from the fluid chamber to permit longitudinal, axial movement of the mandrel relative to the housing upon application of a load to the mandrel in excess of the preload until the mechanical linkage releases the mandrel;

means for adjusting the preload that can be applied to the mandrel without producing longitudinal, axial movement of the mandrel relative to the housing.

11. The jar of claim 10, wherein the means for permitting a preload is a spring, the housing comprises upper and lower housing sections, and the adjusting means comprises:

an adjustable mandrel disposed between amend of the upper housing section and an end of the lower housing section, the adjustment mandrel being axially movable relative to the upper and lower housing sections; and an adjustment sleeve disposed between the housing sections and around the adjustment mandrel, the adjustment sleeve being coupled to the adjustment mandrel such that rotation of the adjustment sleeve relative to the housing sections produces axial movement of the adjustment mandrel relative to the housing sections and adjusts compression of the spring such that a required applied load for the mandrel to be moved against the resistance of the spring preload is adjusted.

12. The jar of claim 11, wherein the adjustment mandrel is an elongated tubular member having threads on each end and the housing section shave threads at the ends for connection to threads at the ends of the upper and lower housing sections such that rotation of the adjustment mandrel relative to the housing sections produces axial movement of the adjustment mandrel relative to the housing sections.

13. The jar of claim 12, wherein the adjustment sleeve is keyed to the adjustment mandrel with an elongated key slot to permit relative axial movement between the adjustment sleeve and the adjustment mandrel as they are being rotated.

* * * * *